US007401406B2

(12) United States Patent
Morisugi et al.

(10) Patent No.: US 7,401,406 B2
(45) Date of Patent: Jul. 22, 2008

(54) NOSE HAIR CUTTER

(75) Inventors: Kazuhiro Morisugi, Inukami (JP); Toshio Ikuta, Hikone (JP); Yoshimichi Kosugi, Echi (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/457,845

(22) Filed: Jul. 17, 2006

(65) Prior Publication Data

US 2007/0022605 A1 Feb. 1, 2007

(30) Foreign Application Priority Data

Jul. 26, 2005 (JP) ..... 2005-216214

(51) Int. Cl.
*B26B 19/00* (2006.01)
*B26B 19/20* (2006.01)
*B26B 19/14* (2006.01)

(52) U.S. Cl. ..... 30/29.5; 30/43.4; 30/43.5; 30/43.6; 30/43

(58) Field of Classification Search ..... 30/29.5, 30/43.4–43.6, 43, 346.51
See application file for complete search history.

(56) References Cited

U.S. PATENT DOCUMENTS 2,269,875 A * 1/1942 Huntington ..... 30/43.6
2,289,323 A * 7/1942 Dettle ..... 30/43.6
2,370,331 A * 2/1945 Susunaga ..... 30/43.6
2,592,198 A * 4/1952 Seeley et al. ..... 30/43.5
3,710,442 A * 1/1973 Meyer ..... 30/43.6
3,925,888 A * 12/1975 Bozsanyi ..... 30/29.5
3,965,569 A * 6/1976 Bolduc ..... 30/29.5
5,012,576 A * 5/1991 Johannesson ..... 30/29.5

FOREIGN PATENT DOCUMENTS

JP 7-313241 12/1995
JP 07313241 A * 12/1995
JP 3536345 3/2004

OTHER PUBLICATIONS

English Language Abstract of JP 7-313241.
U.S. Appl. No. 11/461,601 to Ogawa et al., filed Aug. 1, 2006.
English language Abstract of JP 7-313241.

* cited by examiner

*Primary Examiner*—Joseph J. Hail, III
*Assistant Examiner*—Bryan R Muller
(74) *Attorney, Agent, or Firm*—Greenblum & Bernstein, P.L.C.

(57) ABSTRACT

A main body of an inner blade is inserted into an inner blade insertion hole of an inner blade frame such that the main body can extend and retreat, a tip end cutting edge is pushed by a spring such that it comes into contact with an inner peripheral surface of a slit outer blade, the main body of the inner blade projecting outward from the inner blade insertion hole is bent rearward in a rotational direction, and the cutting edge of the inner blade is located rearward of the main body in the inner blade insertion hole in the rotational direction. With this configuration, the cutting edge does not fall forward in the rotational direction, and no gap is generated between the cutting edge and the inner peripheral surface of the slit outer blade.

7 Claims, 8 Drawing Sheets

NOSE HAIR CUTTER

CROSS REFERENCE TO RELATED APPLICATIONS

This application is based upon and claims the benefit of priority from prior Japanese Patent Application P2005-216214 filed on Jul. 26, 2005; the entire contents of which are incorporated by reference herein.

BACKGROUND OF THE INVENTION

The present invention relates to a nose hair cutter for cutting nose hair.

As a conventional nose hair cutter, as disclosed in Japanese Patent No. 3536345 (Patent document 1, hereinafter) there is a known nose hair cutter including a slit outer blade and an inner blade that is rotated, in which nose hair that enters an inner peripheral surface of the slit outer blade is cut by the inner blade.

According to such a nose hair cutter, as shown in FIG. 1, a main body 1*a* of an inner blade 1 is inserted into an inner blade insertion hole 2*a* of an inner blade frame 2 such that the inner blade 1 can expand and retreat, a tip end cutting edge 1*b* is pushed by a spring (not shown) (pushing direction is shown with arrow a) such that the cutting edge 1*b* comes into contact with an inner peripheral surface 3*a* of a slit outer blade 3.

Normally (likewise in the patent document 1), cutting edges 1*b* of many inner blades 1 is easily formed to have acute angles (to have edges) collectively and thus, the main body 1*a* of the inner blade 1 projecting outward from the inner blade insertion hole 2*a* is forwardly bent in a rotational direction R. Therefore, the cutting edge 1*b* of the inner blade 1 is located closer to a front side than the main body 1*a* in the inner blade insertion hole 2*a* in the rotational direction R.

SUMMARY OF THE INVENTION

If the cutting edge 1*b* of the inner blade 1 is located closer to the front portion than the main body 1*a* in the inner blade insertion hole 2*a* in the rotational direction R, however, when the cutting edge 1*b* comes into contact with the inner peripheral surface 3*a* of the slit outer blade 3 by the pushing force of the spring, the cutting edge 1*b* falls forward in the rotational direction by a component force b of the pushing force a, and a back portion 1*c* comes into contact with the inner peripheral surface 3*a* of the slit outer blade 3. With this configuration, a gap t is generated between the cutting edge 1*b* and the inner peripheral surface 3*a* of the slit outer blade 3. Thus, there is a problem that pieces of nose hair that enter the inner peripheral surface 3*a* from a slit groove 3*b* of the slit outer blade 3 cannot be cut reliably, and cutting sharpness is deteriorated.

The present invention has been achieved to solve the above problem, and it is an object of the invention to provide a nose hair cutter that is devised such that no gap is generated between the cutting edge of the inner blade and the inner peripheral surface of the slit outer blade, thereby enhancing the cutting sharpness.

To solve the above problem, the present invention provides a nose hair cutter including a slit outer blade and an inner blade that is rotated and driven, wherein a main body of the inner blade is inserted into an inner blade insertion hole of an inner blade frame such that the main body can extend and retreat, a tip end cutting edge is pushed by a spring such that it comes into contact with an inner peripheral surface of the slit outer blade, the main body of the inner blade projecting outward from the inner blade insertion hole is bent rearward in a rotational direction, the cutting edge of the inner blade is located rearward of the main body in the inner blade insertion hole in the rotational direction.

According to the present invention, since the cutting edge of the inner blade is located rearward of the main body in the inner blade insertion hole in the rotational direction. With this configuration, when the cutting edge rotates while being in contact with the inner peripheral surface of the slit outer blade by the pushing force of the spring, the cutting edge does not fall forward in the rotational direction. Therefore, no gap is generated between the cutting edge and the inner peripheral surface of the slit outer blade and thus, pieces of nose hair entering into the inner peripheral surface from the slit groove of the slit outer blade can be cut reliably, and the cutting sharpness is enhanced.

To enhance the assembling properties, it is preferable that a detent piece is formed on the main body of the inner blade, a retaining recess is formed in the inner blade insertion hole of the inner blade frame, and the detent piece can be retained to the retaining recess when the main body of the inner blade is inserted.

It is preferable that the inner blade frame is formed with a joint insertion hole of an electric motor that rotates and drives the inner blade, the joint insertion hole passes through the inner blade insertion hole so that the inner blade insertion hole is less prone to be clogged with pieces of cut hair.

BRIEF DESCRIPTION OF THE DRAWINGS

FIG. 2A is a front view and FIG. 2B is a side sectional view;

FIG. 4A is a plan view and FIG. 4B is a front view;

FIG. 7A is a sectional view taken along the line A-A, FIG. 7B is a sectional view taken along the line B-B, and FIG. 7C is a sectional view taken along the line C-C.

DETAILED DESCRIPTION OF THE PREFERRED EMBODIMENTS

Embodiments of the present invention will be explained below with reference to the accompanying drawings.

Figure 2A:
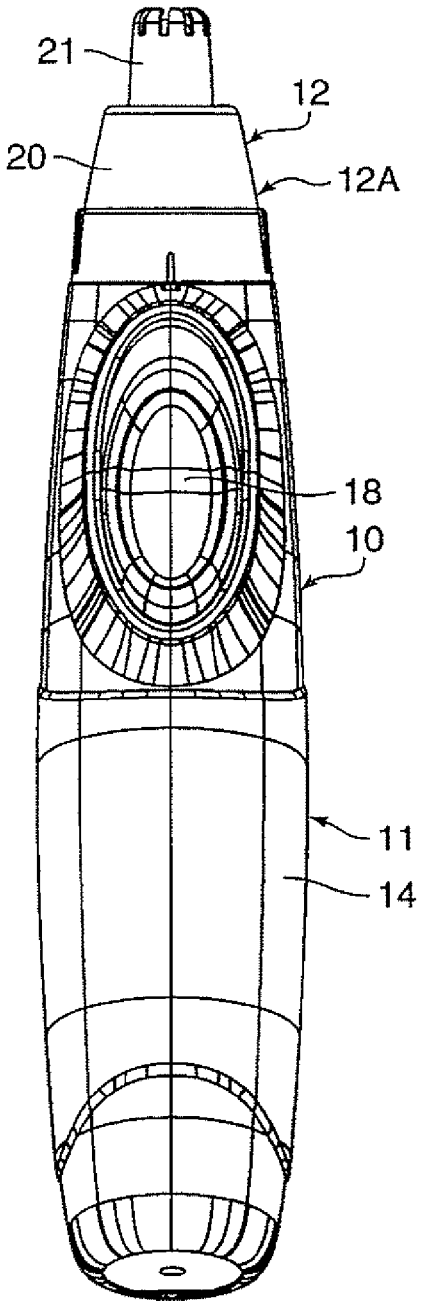
FIGS. 2A and 2B show a nose hair cutter according to an embodiment of the present invention, where
Figure 2B:
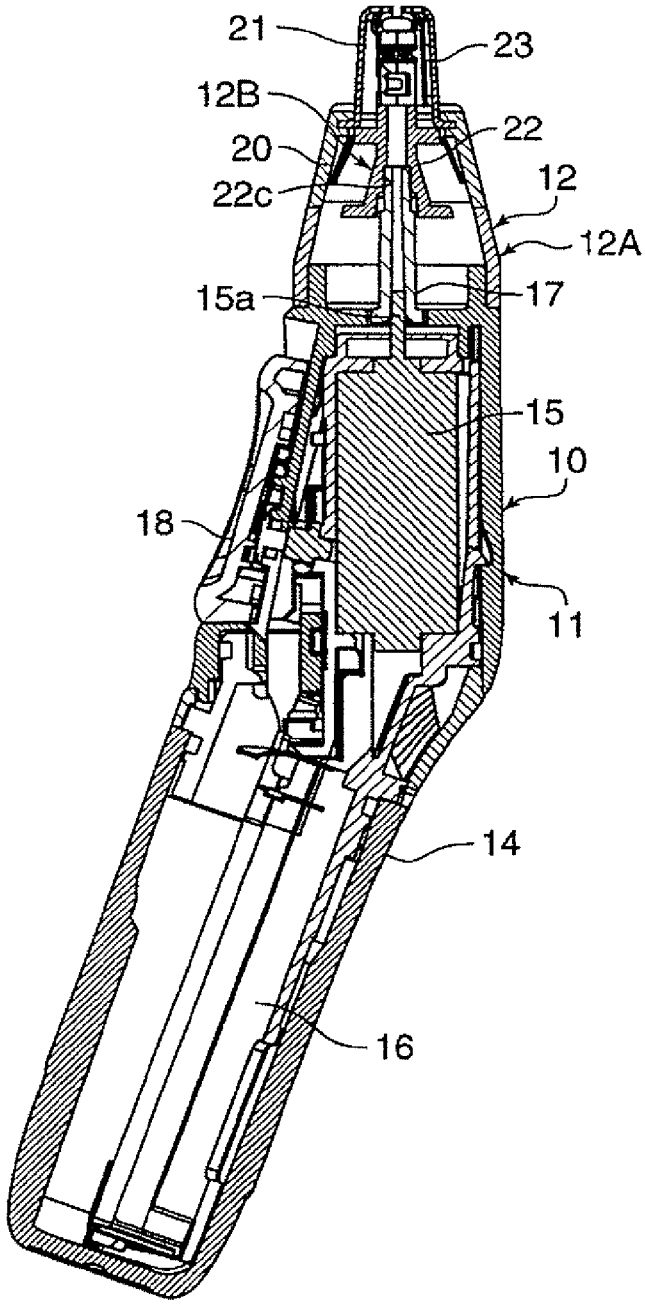

FIG. 2A is a front view of a nose hair cutter 10, and FIG. 2B is a side sectional view of the nose hair cutter 10. The nose hair cutter 10 includes a main body assembly (main body block) 11, and a blade assembly (blade block) 12 detachably amounted on an upper portion of the main body assembly 11.

An electric motor 15 and a dry battery accommodating chamber 16 in which a dry battery for driving the electric motor 15 are provided in a housing 14 of the main body assembly 11. A joint member 17 is press fitted and fixed to an output shaft 15*a* of the electric motor 15. The front surface of said housing 14 is provided with a push button switch 18 for turning the electric motor 15 ON and OFF.

As shown in FIGS. 3 to FIGS. 7A, 7B, and 7C, the blade assembly 12 includes an outer blade block 12A and an inner blade block 12B. The outer blade block 12A includes an outer blade frame 20 and a slit outer blade 21. The inner blade block 12B includes an inner blade frame 22, a pair of inner blades 23 and a coil spring 24.

In the outer blade block 12A, the outer blade frame 20 is formed into a shape of truncated cone pipe, and its top is formed with an opening 20*a*. A bayonet (not shown) is formed on each of a lower portion of the outer blade frame 20 and an upper portion of the main body assembly 11. The outer blade frame 20 is attached to and detached from the upper portion of the main body assembly 11 by twisting and rotating the outer blade frame 20.

The slit outer blade 21 is formed into a cylindrical shape. The slit outer blade 21 is formed with slit grooves 21*b* at equal distances (40° in this embodiment) from one another on its circumference such as to extend from an upper portion to a side portion of the slit outer blade 21.

The slit outer blade 21 is inserted into the opening 20*a* from below the outer blade frame 20, and a base portion 21*c* is fixed to the outer blade frame 20 in a state where the slit outer blade 21 projects upward from the opening 20*a*.

In the inner blade block 12B, the inner blade frame 22 is formed into a cannonball-like shape. The inner blade block 12B is formed at its lower portion with knobs 22*a* used at the time of cleaning operation. The inner blade block 12B is formed at its intermediate portion with positioning projections 22*b* for determining the insertion position when the inner blade block 12B is inserted into the slit outer blade 21 from below. The inner blade frame 22 is formed at its lower portion with a joint insertion hole 22*c* through which the joint member 17 of the output shaft 15*a* of the electric motor 15 is inserted so that the joint member 17 does not rotate. The inner blade frame 22 is rotated by the electric motor 15 through the joint member 17. A later-described inner blade insertion hole 22*d* of the inner blade frame 22 is inserted through the joint insertion hole 22*c*.

The inner blade frame 22 is formed at its upper portion with a slit-like inner blade insertion hole 22*d* extending in a direction perpendicular in its axial direction. A retaining recess 22*e* and a spring insertion hole 22*f* are formed in the inner blade insertion hole 22*d*.

Each of the inner blades 23 is formed into a plate-like shape. A main body 23*a* is formed at its tip upper end with a cutting edge 23*b*, and at its tip lower end with an inclination-preventing portion 23*c* that comes into contact with an inner peripheral surface 21*a* of the slit outer blade 21 so that the cutting edge 23*b* does not incline. The main body 23*a* is integrally formed with a detent piece 23*d* that is formed by cutting and rising a portion of the main body 23*a*

Figure 7A:
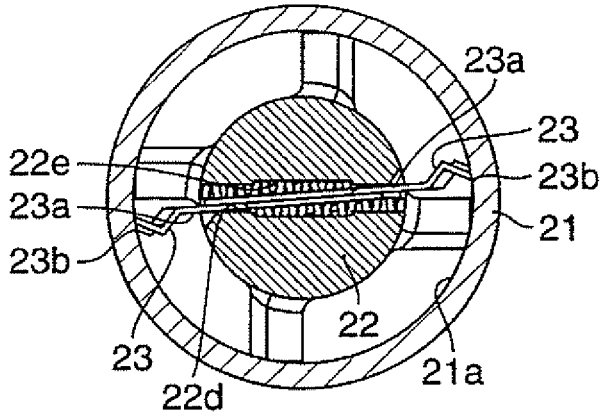
FIGS. 7A to 7C are sectional views of FIG. 4B, where
Figure 7B:
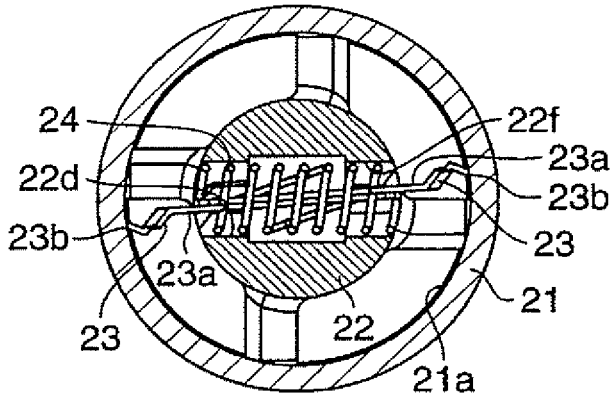
Figure 7C:
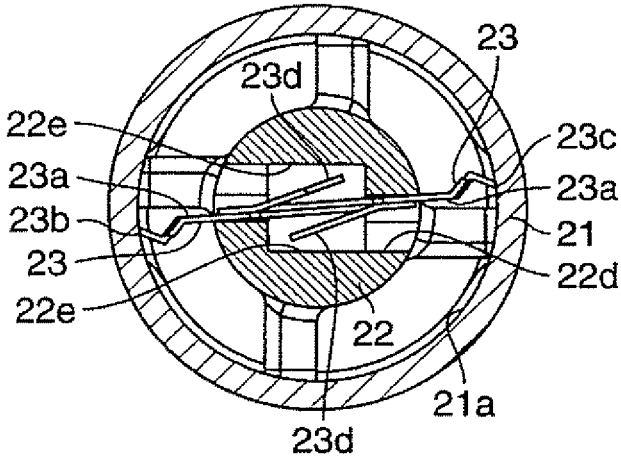
Figure 8:
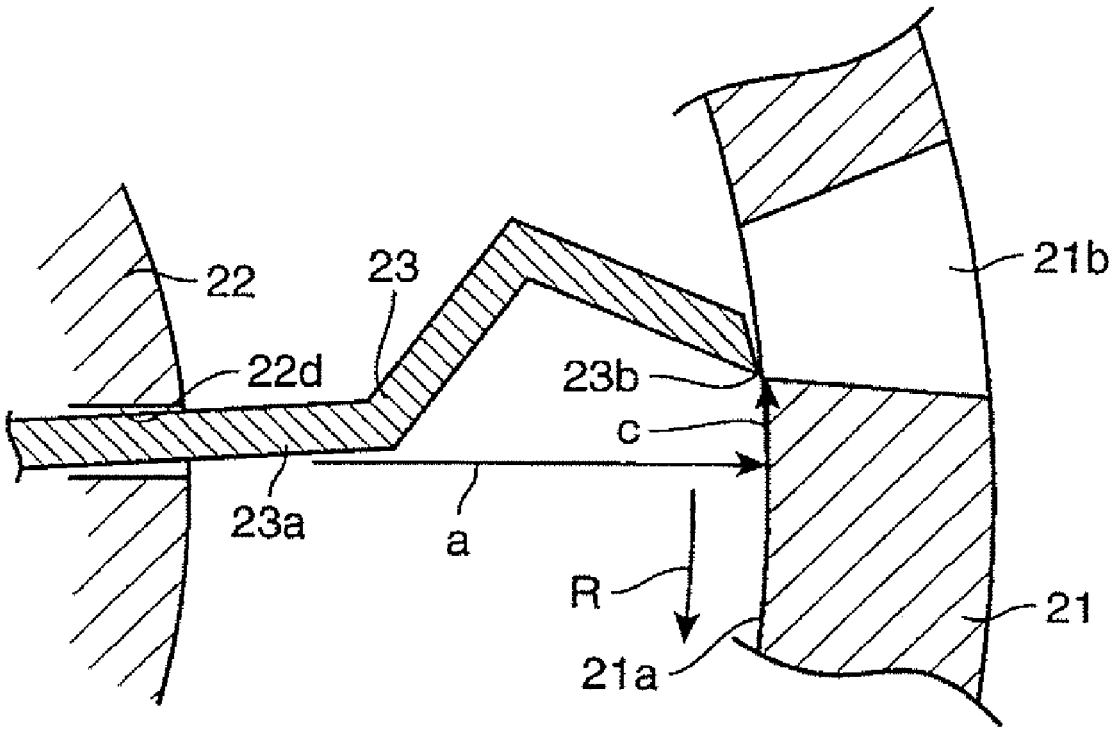
FIG. 8 is a plan sectional view showing a relationship between the inner blade and the slit outer blade according to an embodiment of the invention.

In a state where the spring 24 is inserted into the spring insertion hole 22*f* of the inner blade frame 22, if the main body 23*a* of each inner blade 23 is inserted into the inner blade insertion hole 22*d* from outside against a biasing force of the spring 24 while bending the detent piece 23*d*, the detent piece 23*d* restores in the retaining recess 22*e* in the inner blade insertion hole 22*d*, and the detent piece 23*d* can be retained in the retaining recess 22*e* (see FIG. 7C). With this configuration, in a state where the inner blade 23 is biased outside by the spring 24, the inner blade 23 is retained by the inner blade frame 22 at a constant projection position (position where the cutting edge 23*b* slightly exceeds a position where the cutting edge 23*b* comes into contact with the inner peripheral surface 21a of the slit outer blade 21). The main body 23*a* of each inner blade 23 is inserted into the inner blade insertion hole 22*d* of the inner blade frame 22 such that the main body 23*a* can extend and retreat, and the cutting edge 23*b* at the tip end is pushed and comes into contact with the inner peripheral surface 21*a* of the slit outer blade 21 by the spring 24.

Figure 3:
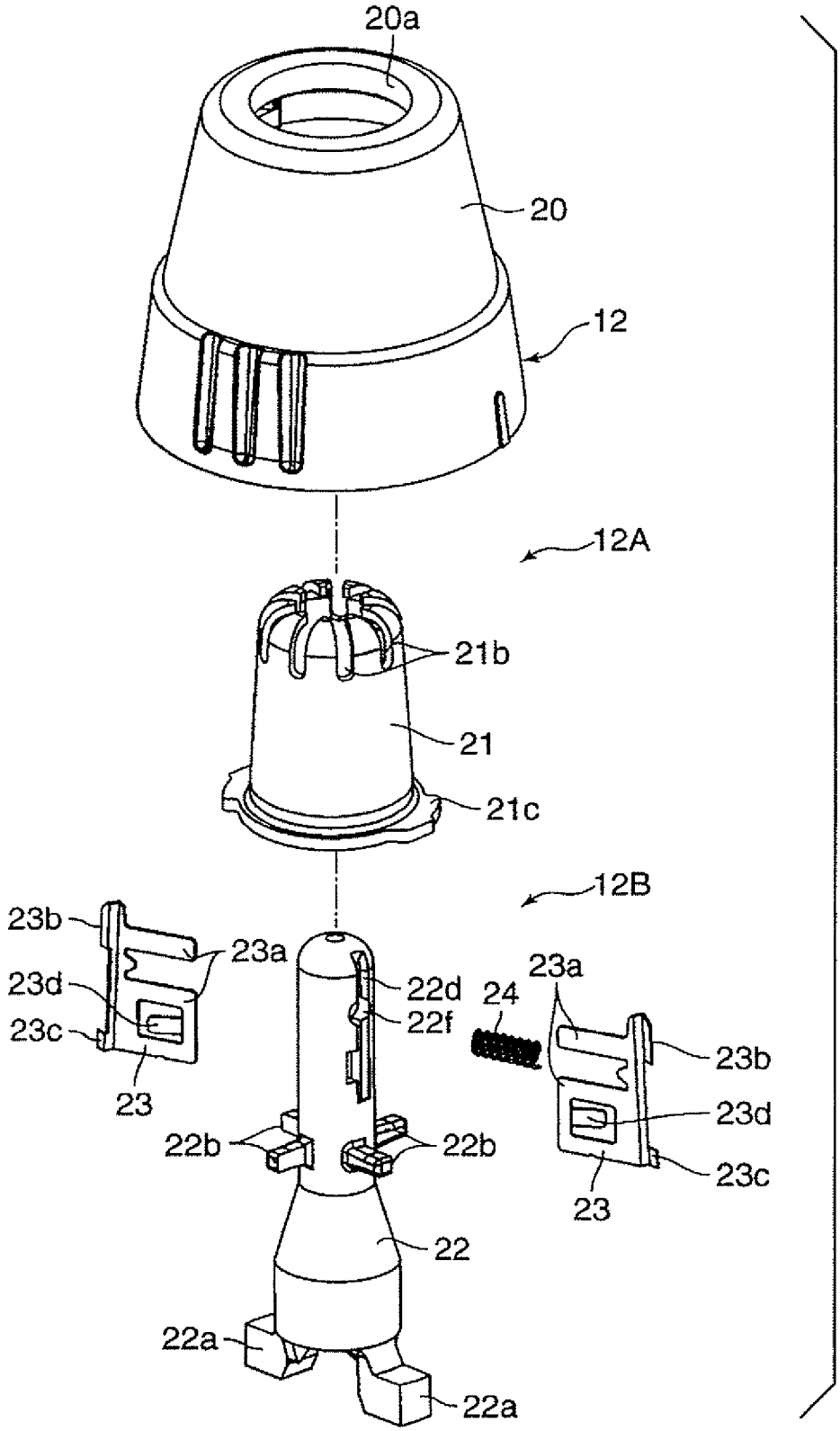
FIG. 3 is an exploded perspective view of a blade assembly.
Figure 4A:
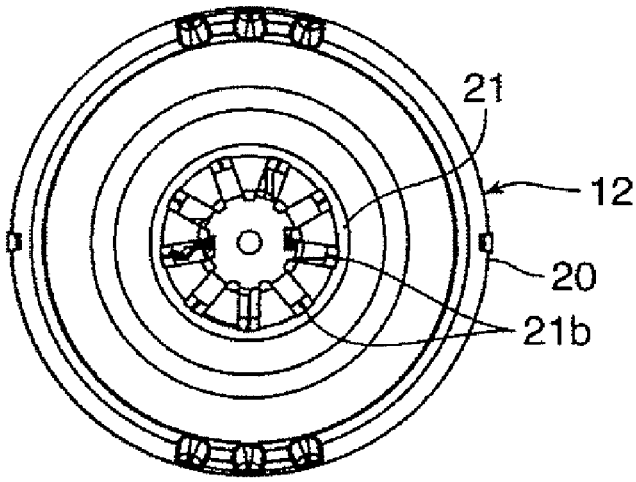
FIGS. 4A and 4B show the blade assembly, where
Figure 4B:
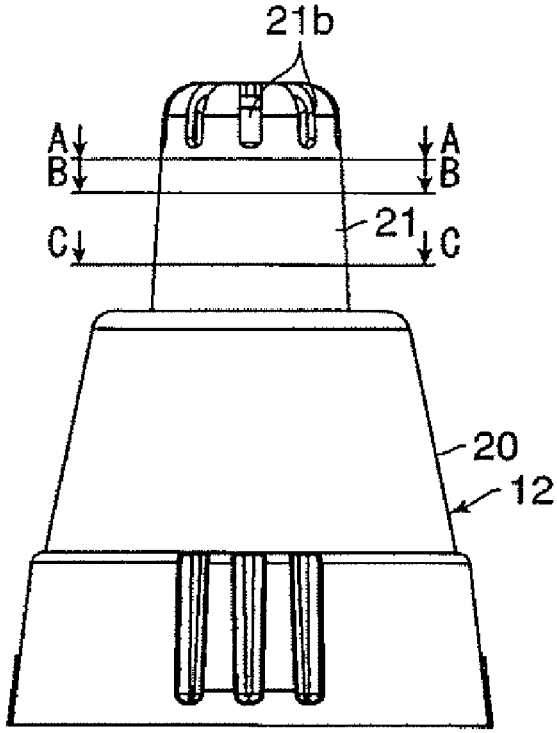
Figure 5:
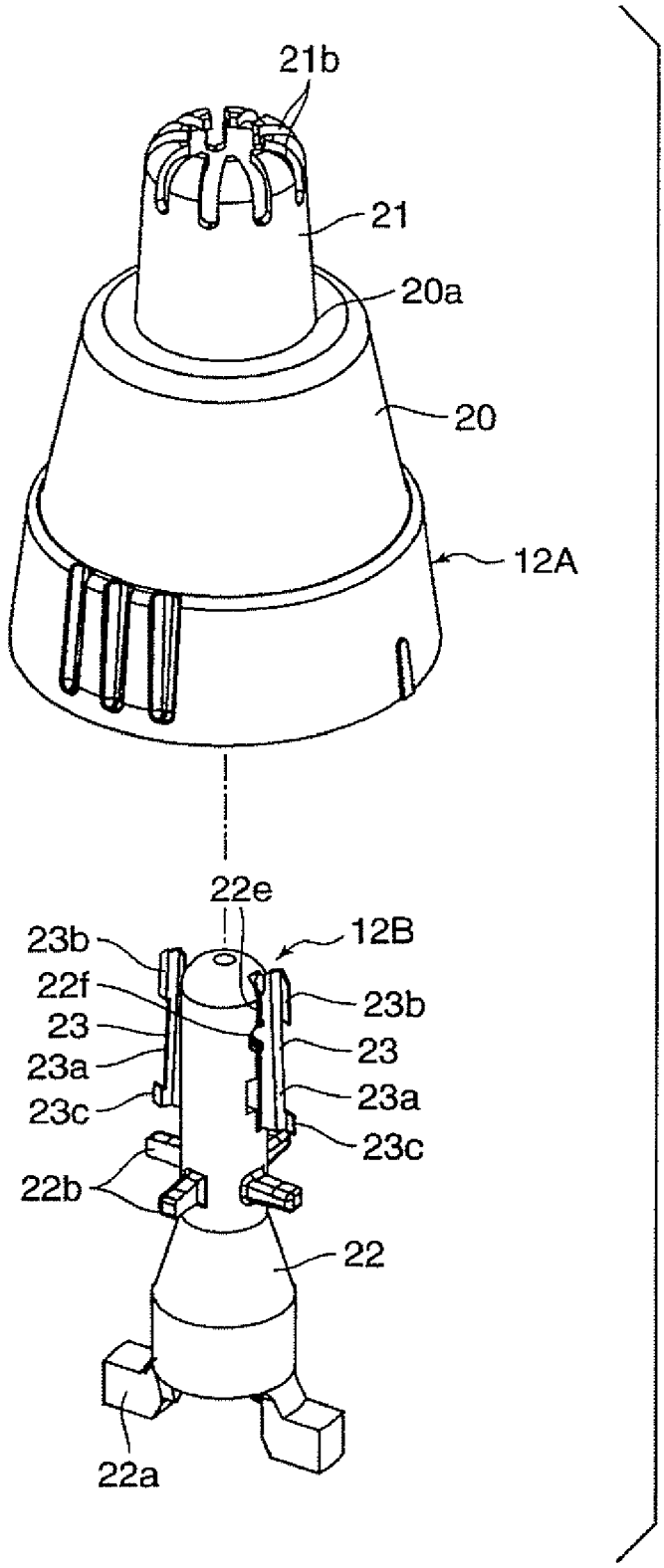
FIG. 5 is a perspective view of an outer blade block and an inner blade block.
Figure 6A:
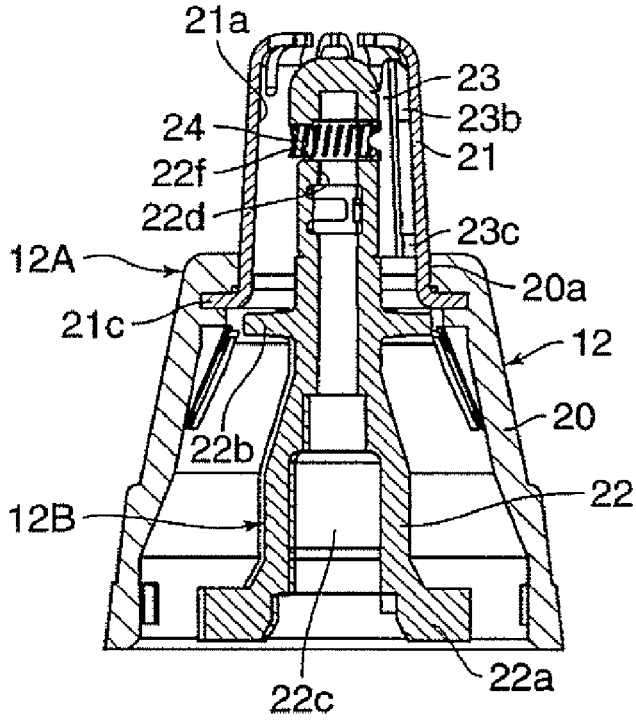
FIG. 6A is a sectional view of a the blade assembly.
Figure 6B:
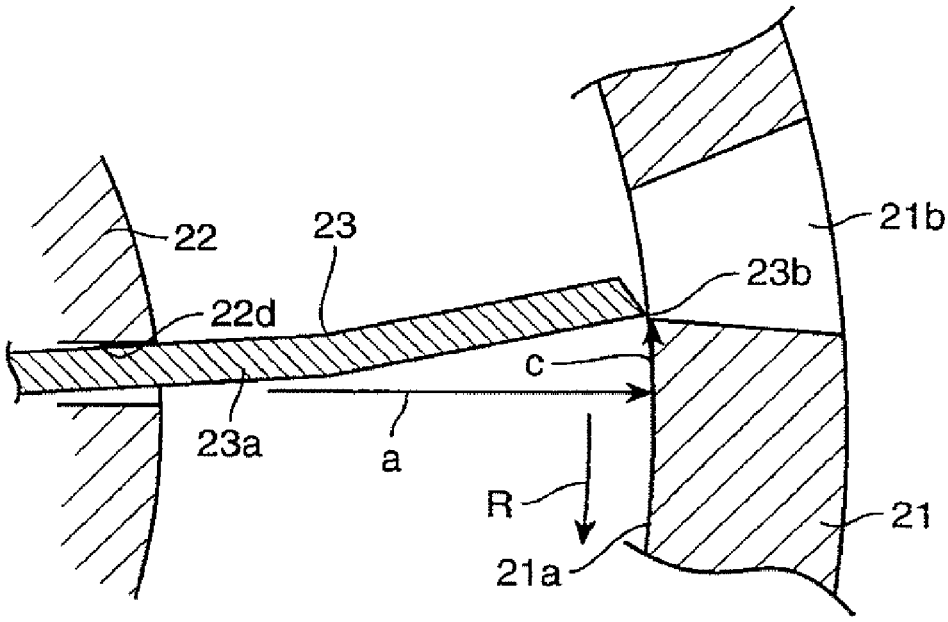
FIG. 6B is a plan sectional view of an inner blade according to a modification.

As shown in FIG. 3 in detail, the inner blade 23 is set such that the main body 23*a* projecting outward from the inner blade insertion hole 22*d* of the inner blade frame 22 is bent into a L-shape rearward of the rotational direction R as viewed from above, and the cutting edge 23*b* is located rearward from the main body 23*a* in the inner blade insertion hole 22*d* in the rotational direction R. The angle of the cutting edge 23*b* is an acute angle with respect to the inner peripheral surface 21*a* of the slit outer blade 21. As shown in FIG. 6B in detail, the inner blade 23 can also be set such that the main body 23*a* projecting outward from the inner blade insertion hole 22*d* of the inner blade frame 22 is bent into a "<"-shape rearward of the rotational direction R as viewed from above, and the cutting edge 23*b* is located rearward from the main body 23*a* in the inner blade insertion hole 22*d* in the rotational direction R.

Figure 1:
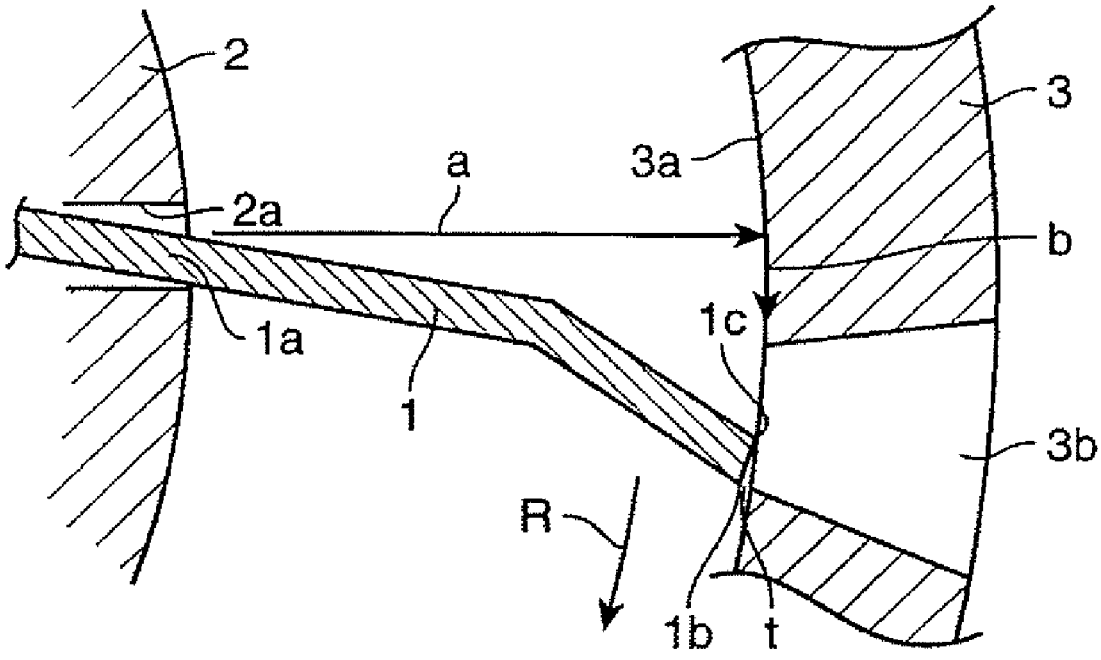
FIG. 1 RELATED ART
FIG. 1 is a plan sectional view showing a relationship between an inner blade and a slit outer blade according to a conventional example.

According to the nose hair cutter 10, if the cutting edge 23*b* of the inner blade 23 is located rearward of the main body 23*a* in the inner blade insertion hole 22*d* in the rotational direction R, the cutting edge 23*b* does not fall forward by a component force (component force in the direction opposite from the component force b of the conventional example shown in FIG. 1) c of the pushing force when the cutting edge 23*b* rotates while being in contact with the inner peripheral surface 21*a* of the slit outer blade 21 by the pushing force a of the spring 24. Thus, no gap (see a symbol t in FIG. 1) is generated between the cutting edge 23*b* and the inner peripheral surface 21*a* of the slit outer blade 21. Therefore, pieces of nose hair that enter the inner peripheral surface 21*a* from the slit grooves 21*b* of the slit outer blade 21 can be cut reliably, and the cutting sharpness is enhanced.

If the main body 23*a* of the inner blade 23 is inserted into the inner blade insertion hole 22*d* of the inner blade frame 22, the detent piece 23*d* of the main body 23*a* is retained to the retaining recess 22*e* with a single operation and thus, the assembling performance becomes favorable. Since no other parts is required for preventing the inner blade 23 from being pulled out, the number of parts can be reduced, the cost is reduced, and variation of assembling size can be reduced.

Since the joint insertion hole 22*c* of the inner blade frame 22 is inserted through the inner blade insertion hole 22*d*, pieces of cut hair entering into the inner blade insertion hole 22*d* fall into the joint insertion hole 22*c*. Therefore, the gap between the inner blade 23 and the inner blade insertion hole 22*d* is less prone to be clogged with the pieces of cut hair, and extending and retreating motion of the inner blade 23 is not hindered. Thus, it is possible to prevent the cutting sharpness from being deteriorated. If the blade assembly 12 is removed from the main body assembly 11 at the time of cleaning, the joint member 17 on the side of the main body assembly 11 is pulled out from the joint insertion hole 22*c* on the side of the blade assembly 12. Thus, the pieces of cut hair that fell into the joint insertion hole 22*c* can be discharged downward from the joint insertion hole 22*c*.

While the embodiment of the present invention has been described above, the invention is not limited to the above embodiment and changes and modifications can be made within the scope of the gist of the present invention.

What is claimed is:

1. A nose hair cutter comprising:

a slit outer blade having an inner peripheral surface;

a rotatable inner blade comprising a main body and a cutting edge, wherein said cutting edge of said inner blade is elastically biased such that it contacts said inner peripheral surface of said slit outer blade; and an inner blade frame having an inner blade insertion hole and a joint insertion hole, wherein said joint insertion hole extends through said inner blade insertion hole to enable an electric motor to rotate said inner blade, wherein said main body of said inner blade is received by said inner blade insertion hole and extends from said inner blade insertion hole, and wherein said main body projects outwardly from said inner blade insertion hole such that said cutting edge is located rearward of said main body, in a rotational direction.

2. The nose hair cutter of claim 1, wherein said cutting edge is rearwardly positioned with respect to a portion of said main body located at said inner blade insertion hole.

3. The nose hair cutter according to claim 1, further comprising:

a detent projecting from said main body of said inner blade;

a retaining recess positioned internally of said inner blade frame, wherein said retaining recess is configured to retain said detent of said main body.

4. The nose hair cutter of claim 1, wherein the main body further comprises:

a first arm extending substantially radially from said inner blade insertion hole, and a second arm extending rearwardly from said first arm in the rotational direction, wherein a bend defines a connection between said first and second arms and said second arm includes said cutting edge.

5. The nose hair cutter of claim 1, wherein the main body further comprises:

a first arm extending substantially radially from said inner blade insertion hole;

a second arm extending rearwardly from said first arm in the rotational direction;

a third arm extending forwardly from said second arm in the rotational direction, wherein a first bend defines a connection between said first and second arms, a second bend defines a connection between said second and third arms, and said third arm includes said cutting edge.

6. A nose hair cutter comprising:

a slit outer blade having an inner peripheral surface;

a rotatable inner blade comprising a main body and a cutting edge, wherein said cutting edge of said inner blade is elastically biased such that it contacts said inner peripheral surface of said slit outer blade; and an inner blade frame having an inner blade insertion hole, and a joint insertion hole extending through said inner blade insertion hole of said inner blade frame to enable an electric motor to rotate said inner blade, wherein said main body of said inner blade is received by said inner blade insertion hole and extends from said inner blade insertion hole, wherein said main body extends substantially radially from said inner blade insertion hole, and wherein said main body projects outwardly from said inner blade insertion hole such that said cutting edge is located rearward of said main body, in a rotational direction.

7. A nose hair cutter comprising:

a slit outer blade having an inner peripheral surface;

a rotatable inner blade comprising a main body having a detent, and a cutting edge, wherein said cutting edge of said inner blade is elastically biased such that it contacts said inner peripheral surface of said slit outer blade; and an inner blade frame having an inner blade insertion hole and a joint insertion hole, wherein said inner blade insertion hole comprises a retaining recess configured to retain said detent of said main body and said joint insertion hole extends through said inner blade insertion hole to enable an electric motor to rotate said inner blade, wherein said main body of said inner blade is received by said inner blade insertion hole and extends from said inner blade insertion hole, and wherein said main body projects outwardly from said inner blade insertion hole such that said cutting edge is located rearward of said main body, in a rotational direction.

* * * * *